United States Patent [19]

Kueny et al.

[11] 4,140,089

[45] Feb. 20, 1979

[54] PRESSURE CONTROLLED ENGINE COOLING SYSTEM

[75] Inventors: Don F. Kueny, Waukegan; James S. Nerstrom, Gurnee, both of Ill.

[73] Assignee: Outboard Marine Corporation, Waukegan, Ill.

[21] Appl. No.: 659,274

[22] Filed: Feb. 19, 1976

[51] Int. Cl.[2] ..... F01P 7/14

[52] U.S. Cl. ..... 123/41.08; 137/510

[58] Field of Search ..... 123/41.08; 137/510

[56] References Cited

U.S. PATENT DOCUMENTS

| | | | |
|---|---|---|---|
| 1,770,912 | 7/1930 | Clapp | 137/510 |
| 1,884,810 | 10/1932 | Muller | 137/510 |
| 1,885,000 | 10/1932 | Muller | 137/510 |
| 2,074,292 | 3/1937 | Wilkins | 137/510 |
| 2,146,092 | 2/1939 | Raymond | 137/510 |
| 2,326,825 | 8/1943 | Bucknam | 137/510 |
| 2,599,979 | 6/1952 | Drane | 137/510 X |
| 3,105,472 | 10/1963 | Jasper | 123/41.08 |
| 3,521,610 | 7/1970 | Coudriet | 123/41.08 |
| 3,621,907 | 11/1971 | Ephraim | 123/41.08 |
| 3,667,431 | 6/1972 | Kueny | 123/41.08 |
| 3,720,372 | 3/1973 | Jacobs | 123/41.08 |
| 3,918,418 | 11/1975 | Horn | 123/41.08 |
| 3,939,807 | 2/1976 | Eichinger | 123/41.08 |

FOREIGN PATENT DOCUMENTS

| | | | |
|---|---|---|---|
| 494109 | 5/1919 | France | 137/510 |

*Primary Examiner*—Charles J. Myhre

*Assistant Examiner*—Jeffrey L. Yates

*Attorney, Agent, or Firm*—Michael, Best & Friedrich

[57] ABSTRACT

Disclosed herein is a pressure valve for use in any one of several cooling systems for different internal combustion engines also disclosed herein. The pressure valve is connected in series with a source of coolant and an engine coolant jacket for affording coolant flow from the source through the coolant jacket when the pressure in the coolant is above a first value and for affording continued coolant flow through the coolant jacket until the pressure in the coolant falls below a second value lower than the first value. The pressure valve comprises wall means defining a chamber having an inlet and an outlet including a valve seat, together with a valve member having a first surface movable relative to a closed position wherein the first surface sealingly engages the valve seat, which valve member also has a second surface facing away from the first surface. Means biasing the valve member toward the closed position are provided, together with a diaphragm having a portion connected to the valve member for proportionately related movement in common with the valve member, the diaphragm having a side surface positioned in spaced relation with respect to the second surface of the valve member so that liquid entering the inlet at a pressure above the first value is effective to displace the valve member from the closed position and so that the valve member remains displaced from the closed position until the pressure in the liquid entering the inlet falls below the second value.

21 Claims, 6 Drawing Figures

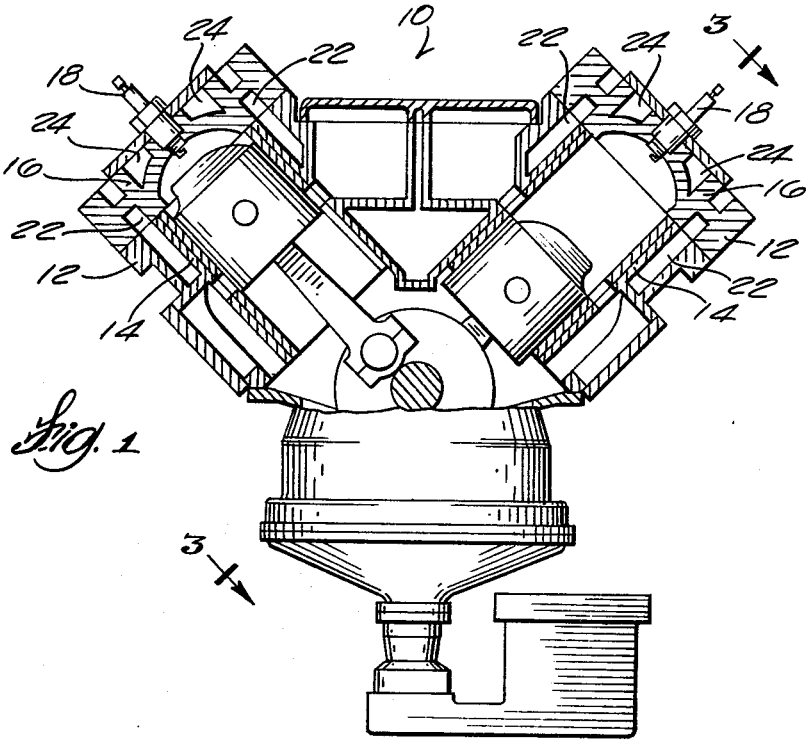
Fig. 1
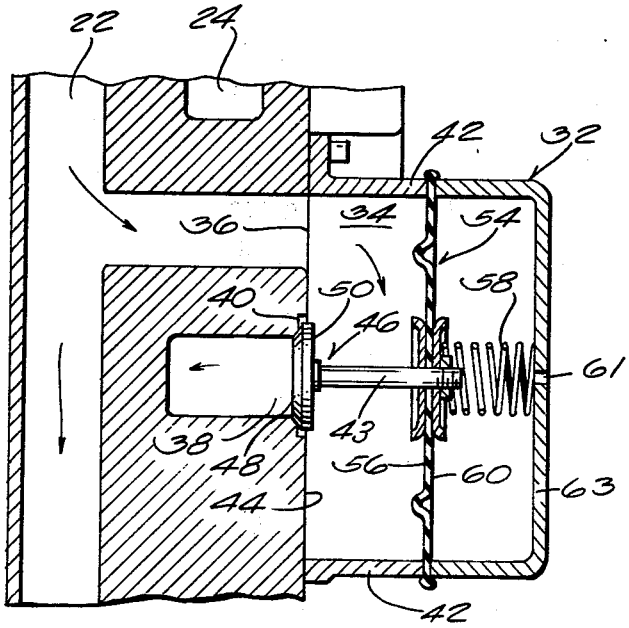
Fig. 5
Fig. 6
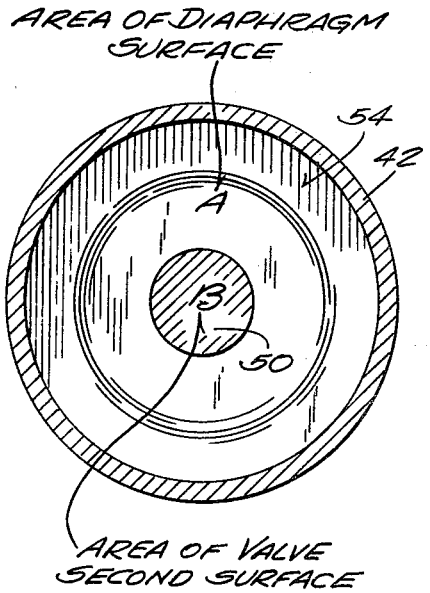

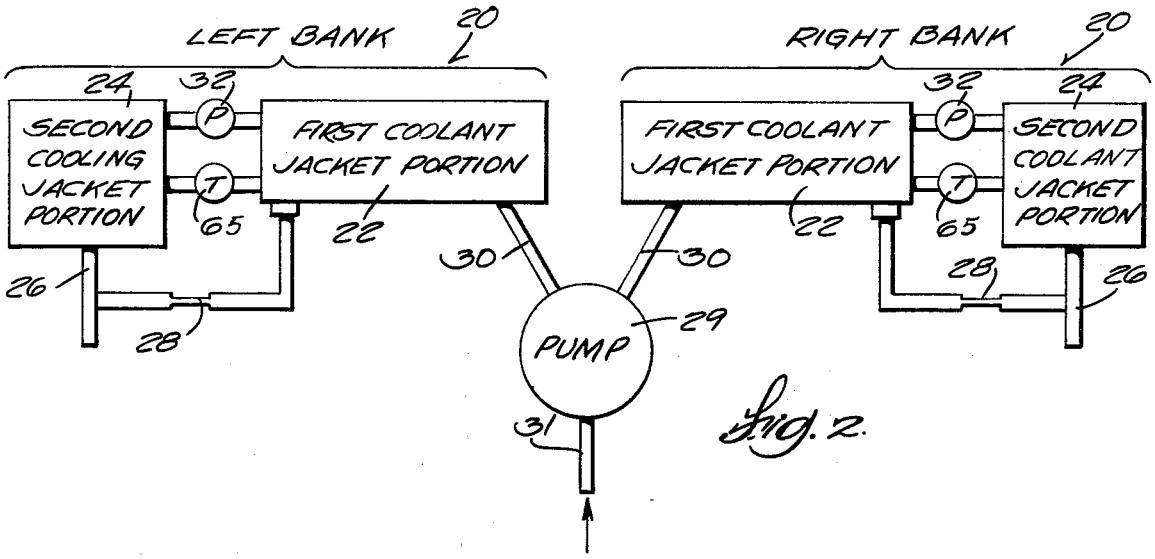
Fig. 2.
Fig. 3
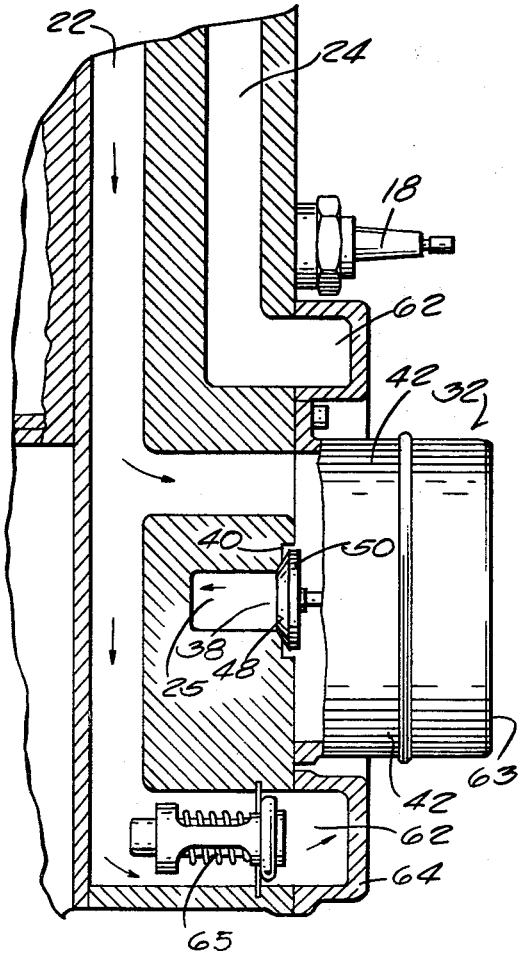
Fig. 4
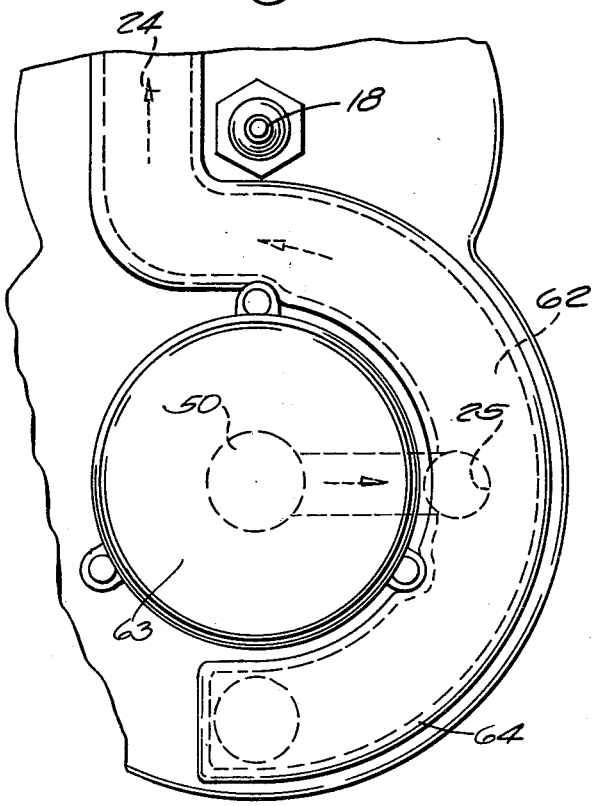

PRESSURE CONTROLLED ENGINE COOLING SYSTEM

BACKGROUND OF THE INVENTION

The invention relates generally to the cooling of internal combustion engines and, more particularly to pressure controlled cooling of marine engines. Prior cooling systems are disclosed in the pending U.S. application Ser. No. 444,049, now U.S. Pat. No. 3,908,579, filed Feb. 20, 1974, and in the Kueny U.S. Pat. No. 3,667,431 issued June 6, 1972.

SUMMARY OF THE INVENTION

In accordance with an embodiment of the invention, the invention provides a pressure valve for use in liquid cooled internal combustion engines comprising wall means defining a chamber having an inlet and an outlet including a valve seat, together with a valve member having a first surface and being movable relative to a closed position wherein the first surface sealingly engages the valve seat, the valve member also having a second surface facing away from the first surface. In addition, the pressure valve includes means biasing the valve member toward the closed position, and a diaphragm having a portion connected to the valve member for proportionately related movement in common with the valve member, the diaphragm having a side surface positioned in spaced relation with respect to the second surface of the valve member so that liquid entering the inlet at a pressure above a first value is effective to displace the valve member from the closed position and so that the valve member remains displaced from the closed position until the pressure in the liquid entering the inlet falls below a second value less than the first value.

Also in accordance with an embodiment of the invention, the invention provides an internal combustion engine comprising one or more cylinders each having a cylindrical portion and a head portion with a spark plug mounted therein, together with a cooling system comprising a coolant jacket for cooling one of the cylindrical portion and the head portion. The cooling system also includes means for supplying coolant to the coolant jacket and a discharge conduit connected to the coolant jacket for discharging coolant from the coolant jacket. A pressure responsive valve means is connected between the coolant jacket and one of the supply means and the discharge conduit for affording coolant flow from the supply means through the coolant jacket when the pressure in the coolant supplied from the supply means is above a first value and for affording continued coolant flow from the conduit through the coolant jacket until the pressure in the coolant supplied from the supply means falls below a second value lower than the first value.

Also in accordance with an embodiment of the invention, the invention provides an internal combustion engine including a cooling system comprising a coolant jacket having a first portion for cooling a first part of the engine and a second portion for cooling a second part of the engine, means for supplying coolant to the first coolant jacket portion, a discharge conduit connected to the second coolant jacket portion for discharging coolant from the second coolant jacket portion, and pressure responsive valve means connected between the first and second coolant jacket portions for affording coolant flow from the first coolant jacket portion to the second coolant jacket portion when the pressure in the coolant in the first coolant jacket portion is above a first value and for affording continued coolant flow from the first coolant jacket portion to the second coolant jacket portion until the pressure in the coolant in the first coolant jacket portion falls below a second value lower than the first value.

Also in accordance with an embodiment of the invention, the invention provides a V-type internal combustion engine including a first cylinder bank and a second cylinder bank, each of the cylinder banks including one or more cylinders each having a cylindrical portion and a head portion with a spark plug mounted therein, and each of the cylinder banks also having a cooling system. Each cooling system includes a coolant jacket having a first portion for cooling the area in the vicinity of the cylindrical portion and a second portion for cooling the area in the vicinity of the head portion, a discharge conduit connected to the second coolant jacket portion for discharging coolant from the second coolant jacket portion, means for supplying coolant to the first coolant jacket portion, and pressure responsive valve means connected between the first and second coolant jacket portions for affording coolant flow from the first coolant jacket portion to the second coolant jacket portion when the pressure in the coolant in the first coolant jacket portion is above a first value and for affording continued coolant flow from the first coolant jacket portion to the second coolant jacket portion until the pressure in the coolant in the first coolant jacket portion falls below a second value lower than the first value.

Also in accordance with an embodiment of the invention, the invention provides an internal combustion engine including supply means comprising an engine driven pump for supplying coolant to the first coolant jacket portion from a source, the engine further including bypass means for affording a restricted coolant flow between the first coolant jacket portion and the discharge conduit.

Still further in accordance with an embodiment of the invention, the invention provides an internal combustion engine including a thermostatic valve means connected between the first coolant jacket portion and the second coolant jacket portion for affording coolant flow from the first coolant jacket portion to the second coolant jacket portion when the coolant is above a predetermined temperature.

One of the principal features of the invention is the provision of a pressure valve for use in liquid cooled internal combustion engines, which pressure value includes a valve member which is displaced from a closed position when the pressure in the coolant is above a first value and which remains displaced from the closed position until the pressure in the coolant falls below a second value lower than the first value.

Another of the principal features of the invention is the provision of an internal combustion engine having a cooling system which allows the engine to operate at a relatively hot temperature during relatively low speed engine operation, and which allows the engine to operate at a relatively cool temperature during relatively high speed engine operation.

Another of the principal features of the invention is the provision of an internal combustion engine having a cooling system with a pressure valve including a valve member which remains displaced from a closed position when the engine speed is reduced from a relatively high speed to provide cooling of the engine following such high speed operation.

DRAWINGS

FIG. 1 is a schematic sectional view of a V-type internal combustion engine embodying various of the features of the invention.

FIG. 2 is a diagramatic view of the cooling system embodied in the engine shown in FIG. 1.

FIG. 3 is a partial sectional view taken along line 3—3 of FIG. 1.

FIG. 4 is a partial top plan view of the portion of the engine shown in FIG. 3.

FIG. 5 is a sectional view of a pressure valve incorporated in the engine shown in FIG. 3.

FIG. 6 is a diagramatic view illustrating the relative areas of the diaphragm side surface and the valve member second surface of the pressure valve shown in FIG. 5.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

The subject matter of Kueny U.S. Pat. No. 3,667,431, issued June 6, 1972, is hereby incorporated by reference.

Shown in the drawings is a V-type internal combustion engine 10 including a pair of cylinder banks 12. Each of the cylinder banks 12 includes one or more cylinders having a cylindrical portion 14 and a head portion 16 with a spark plug 18 mounted therein and also includes a cooling system having a water coolant jacket 20. While various arrangements are possible, each of the coolant jackets 20 is preferably divided into two portions and has a first portion 22 for cooling the area in the vicinity of the cylindrical portion 14 and a second portion 24 for cooling the area in the vicinity of the head portion 16. A discharge conduit 26 is connected to the second coolant jacket portion 24 for discharging coolant from the second coolant jacket portion 24. A bypass means or bypass conduit 28 connected between the first coolant jacket portion 22 and the discharge conduit 26 can be provided for affording restricted coolant flow between the first coolant jacket portion 22 and the discharge conduit 26. It is to be understood that the above described components of the cooling system can be formed in any conventional manner such as from a combination of cast engine parts.

Means for supplying coolant to each of the first coolant jacket portions 22 are provided. While various arrangements are possible, preferably the supply means comprises an engine driven pump 29 which communicates with supply conduits 30 connected between the pump 29 and the first coolant jacket portions 22. The pump 29 can be of a conventional, flexible vane type and should be capable of providing an increasing volume of water or coolant at an increasing pressure upon an increase in engine speed, as will be discussed in more detail below. In a marine environment, the pump includes an inlet 31 which communicates with the water from the lake or stream in which the boat mounted engine 10 is operating.

A pressure responsive valve means or pressure valve 32 is connected between the first and second coolant jacket portions 22 and 24, respectively, for affording coolant flow from the first coolant jacket portion 22 to the second coolant jacket portion when the pressure in the coolant in the first jacket portion 22 is above a first value and for affording continued coolant flow from the first coolant jacket portion 22 to the second coolant jacket portion 24 until the pressure in the coolant in the first coolant jacket portion 22 falls below a second value lower than the first value.

The pressure valve 32 comprises wall means defining a chamber 34 having an inlet 36, and an outlet 38, which outlet 38 includes a valve seat 40. The walls means comprises a pair of sidewalls 42 connected to a cast part of the engine 10 and a front wall 44. The front wall 44 includes the inlet 36 which communicates with the first coolant jacket portion 22 and the chamber 34 and includes the outlet 38 and valve seat 40 which communicate with the chamber 34 and with the second coolant jacket portion 24 through a passageway 25 connected to a passageway 62 provided in a head cover 64 of the engine 10 as will be further described below.

The pressure valve 32 also includes a diaphragm 54 including a first side surface 56 which extends between the sidewalls 42 and forms a rear wall further defining the chamber 34. The diaphragm 54 can be composed of any generally flexible durable material such as rubber and, in the preferred embodiment, has a second side surface 60 which communicates with the atmosphere through a vent 61 in a rear cover 63, which cover 63 is connected to the sidewalls 42.

The pressure valve 32 further includes a valve member 46 having a first surface 48 and being movable relative to a closed position wherein the first surface 48 sealingly engages the valve seat 40. The valve member 46 also has a second surface 50 facing away from the first surface 48. Preferably the pressure valve 32 includes a shaft 43 connected to the valve member second surface 50 and to a portion of the first side surface 56 of the diaphragm 54.

Means biasing the valve 46 toward the closed position are provided. The biasing means can comprise spring means of any arrangement acting directly or indirectly on the valve member 46, and, in the preferred embodiment, the bias means comprises a compressed spring 58 connected between the second side surface 60 of the diaphragm 54 and the rear cover 63.

The diaphragm 54 is connected to the valve member 46 by the shaft 43 for proportionately related movement in common with the valve member 46. The diaphragm first side surface 56 is positioned in spaced relation with respect to the second surface 50 of the valve member 46 so that liquid entering the inlet 36 at a pressure above a first value is effective to displace the valve 46 from the closed position and so that the valve member 46 remains displaced from the closed position until the pressure in the liquid entering the inlet 36 falls below a second value less than the first value. More specifically, the first side surface 56 of the diaphragm faces toward the valve member second surface 50 so that when the valve member 46 is in the closed position, the pressure in the liquid entering the inlet 36 acts in opposite directions on the second surface 50 of the valve member 46 and on the first side surface 56 of the diaphragm 54. As a result, as shown diagramatically in FIG. 6, the pressure in the liquid tending to displace the valve member 46 from the closed position effectively acts on the area A of the first side surface 56 of the diaphragm minus the area B of the valve member second surface 50.

When the pressure in the liquid entering the inlet 36 is above the first value, the valve member 46 including the valve member first surface 48 is displaced from the closed position. The effect of the pressure in the liquid acting on the exposed first surface 48 of the valve 46 generally cancels the effect of the pressure acting on the second surface 50 of the valve member 46 and therefore, the pressure in the liquid tending to maintain the valve member 46 displaced from the closed position effectively acts on the whole area A of the first side surface 56 of the diaphragm 54.

This effective change in the area of the diaphragm first side surface 56 subject to the pressure in the liquid between valve member closed and valve member open positions results in the pressure valve 32 having hysteresis characteristics. More specifically, once the valve 46 is displaced from a closed position, the pressure in the liquid effectively acts on a greater area of the diaphragm first side surface 56 resulting in the valve member 46 snapping fully open. Further, the valve member 46 remains displaced from the closed position until the pressure in the liquid falls below a second value less than the first value needed to initiate displacement of the valve member. The difference between the first and second pressure values can be regulated by adjusting the relative areas of the valve member second surface 50 and the diaphragm first side surface 56. Preferably, the first pressure value is about 5 p.s.i. greater than the second pressure value to provide better cooling characteristics and more efficient engine performance as will be explained in more detail below.

During relatively low speed engine operations, it is desirable to maintain the engine at a relatively hot temperature. This desirable relatively hot temperature operation at low speeds results from the use of the pressure valve 32 which prevents coolant flow through the outlet 38 to the second coolant jacket portion 24 until the pressure in the coolant entering the inlet 36 is above a first value. The first pressure value at which the valve member 46 opens can be relatively higher or set to correspond with the pressure generated at a relatively high engine speed, resulting in the desired engine operation at low speeds.

During relatively high speed engine operation, it is desirable to maintain the engine at a relatively cool operating temperature. The cool operating temperature of the engine results in greater engine power output. At relatively high engine speeds, when the pressure in the coolant does exceed the first pressure value, because the pressure valve 32 has the above described hysteresis characteristics, the valve member 46 opens fully minimizing the pressure drop at the outlet 38, and assures flow of coolant resulting in a relatively cool engine temperature until the pressure in the coolant falls below a second value lower than the first value.

For purposes of example only, as the engine speed increases from 600 rpm, idle, to 6,000 rpm, full throttle, the pressure in the coolant produced by the engine driven pump 29 increases from about 5 p.s.i. to about 18 p.s.i. At low engine speeds below 4,000 rpm or coolant pressure below a first value of about 15 p.s.i., the valve member 46 will not open and hence the engine at low speeds below 4,000 rpm is maintained at a desired relatively hot temperature. At relatively high engine speeds above 4,000 rpm and coolant pressure above about 15 p.s.i., because of the pressure value's hysteresis characteristics, the valve member 46 will be displaced from its closed position opening fully to afford increased coolant flow through the first coolant jacket portion 22 into the second coolant jacket portion 24 and out through the discharge conduit 26, thus maintaining the engine at a relatively cool operating temperature. In addition, the valve member 46 will remain open affording coolant flow through the second coolant portion 24 until the pressure in the coolant has dropped below a second value lower than the first such as at a coolant pressure of about 10 p.s.i. at an engine speed of 2,500 rpm. The transient heat resulting from high speed or full throttle operation is therefore reduced by the coolant continuing to flow through the second coolant jacket portion after the engine speed has been reduced below the 4,000 rpm at which the valve member 46 first opened, thus preventing overheating of the engine during slow-down from high speed or full throttle operation. Preferably, the first value of pressure in the coolant which displaces the valve member 46 from its closed position is about 5 p.s.i. greater than the second value of the pressure in the coolant when the valve member 46 closes.

As shown in FIG. 3, a conventional thermostatic valve 65 can be provided and positioned in parallel with the pressure valve 32 between the first and second coolant jacket portions to further regulate the temperature of the coolant in the first coolant jacket portion 22. A passageway 62 is provided in a head cover 64 of the engine 10 to allow coolant to flow from the thermostatic valve 65 around the passageway valve 32 into the second coolant jacket portion 24 when the thermostatic valve 65 is open. Preferably, the thermostatic valve 65 affords coolant flow from the first coolant jacket portion to the second coolant jacket portion at a temperature above about 140° F.

Although the above description was given for a V-type internal combustion engine, it should be understood that in its broadest aspects, the invention disclosed herein can readily be applied to an internal combustion engine having a single cylinder bank having one or more cylinders. Further, it is to be understood that the invention could be utilized with the first and second coolant jacket portions relocated and combined into a single coolant jacket with the pressure valve located between the single coolant jacket and one of the supply means and the discharge conduit. Also, a thermoplastic valve could be positioned in parallel with the pressure valve to further regulate the temperature of the coolant in an engine having a single coolant jacket. In addition, the bypass means could be eliminated from an engine having first and second coolant jacket portions with the result that the coolant would flow through the coolant jacket portions and out the discharge conduit only after opening of one of the pressure valve and the thermostatic valve.

Various features of the invention are set forth in the following claims:

What is claimed is:

1. An internal combustion engine comprising one or more cylinders each having a cylindrical portion and a head portion with a spark plug mounted therein, a cooling system comprising a coolant jacket for cooling one of said cylindrical portion and said head portion, means for supplying coolant to said coolant jacket, a discharge conduit connected to said coolant jacket for discharging coolant from said coolant jacket, and pressure responsive valve means connected between said coolant jacket and one of said supply means and said discharge conduit for affording coolant flow from said supply means through said coolant jacket when the pressure in the coolant supplied from said supply means is above a first value and for affording continued coolant flow from said supply means through said coolant jacket until the pressure in the coolant supplied from said supply means falls below a second value lower than said first value.

2. An engine in accordance with claim 1 wherein said first value is about 5 p.s.i. greater than said second value.

3. An engine in accordance with claim 1 wherein said supply means comprises an engine driven pump for supplying conduit to said coolant jacket from a source.

4. An engine in accordance with claim 1 wherein said pressure responsive valve means comprises wall means defining a chamber having an inlet in communication with said supply means and having an outlet including a valve seat in communication with said discharge conduit, a valve member having a first surface and being movable relative to a closed position wherein said first surface sealingly engages said valve seat, said valve member also having a second surface facing away from said first surface, means biasing said valve member toward said closed position, and a diaphragm having a portion connected to said valve member for related movement in common with said valve, said diaphragm having a side surface positioned in spaced relation with respect to said second surface of said valve member so that coolant entering said inlet supplied from said supply means at a pressure above said first value is effective to displace said valve member from said closed position, and so that said valve member remains displaced from said closed position until the pressure in the coolant entering said inlet falls below said second value.

5. An internal combustion engine in accordance with claim 1 further including a thermostatic valve means connected between said coolant jacket and one of said supply means and said discharge conduit for affording coolant flow from said supply means through said coolant jacket when said coolant is above a predetermined temperature.

6. An engine in accordance with claim 5 wherein said predetermined temperature is about 140° F.

7. An internal combustion engine including a cooling engine comprising a coolant jacket having a first portion for cooling of a first part of said engine and a second portion for cooling of a second part of said engine, means for supplying coolant to said first coolant jacket portion, a discharge conduit connected to said second coolant jacket portion for discharging coolant from said second coolant jacket portion, and pressure responsive valve means connected between said first and second coolant jacket portions for affording coolant flow from said first coolant jacket portion to said second coolant jacket portion when the pressure in the coolant in said first coolant jacket portion is above a first value and for affording continued coolant flow from said first coolant jacket portion to said second coolant jacket portion until the pressure in the coolant in said first coolant jacket portion falls below a second value lower than said first value.

8. An internal combustion engine in accordance with claim 7 wherein said first value is about 5 p.s.i. greater than said second value.

9. An internal combustion engine in accordance with claim 7 including one or more cylinders each having a cylindrical portion and a head portion with a spark plug mounted therein and wherein said first engine part includes the area in the vicinity of said cylindrical portion and wherein said second engine part includes the area in the vicinity of said head portion.

10. An engine in accordance with claim 7 further including bypass means for affording restricted coolant flow between said first coolant portion and said discharge conduit.

11. An engine in accordance with claim 7 wherein said supply means comprises an engine driven pump for supplying coolant to said first coolant jacket portion from a source.

12. An internal combustion engine in accordance with claim 7 wherein said pressure responsive valve means comprises wall means defining a chamber having an inlet in communication with said first coolant jacket portion and having an outlet including a valve seat in communication with said second coolant jacket portion, a valve member having a first surface and being movable relative to a closed position wherein said first surface sealingly engages said valve seat, said valve member also having a second surface facing away from said first surface, means biasing said valve member toward said closed position; and a diaphragm having a portion connected to said valve member for related movement in common with said valve member, said diaphragm having a side surface positioned in spaced relation with respect to said second surface of said valve member so that coolant entering said inlet from said first coolant jacket portion at a pressure above said first value is effective to displace said valve member from said closed position, and so that said valve member remains displaced from said closed position until the pressure in the coolant entering said inlet falls below said second value.

13. An internal combustion engine in accordance with claim 7 including a thermostatic valve means connected between said first and second coolant jacket portions for affording coolant flow from said first coolant jacket portion to said second coolant jacket portion when the coolant is above a predetermined temperature.

14. An internal combustion engine in accordance with claim 13 wherein said predetermined temperature is about 140° F.

15. A V-type internal combustion engine including a first cylinder bank and a second cylinder bank, each of said cylinder banks including one or more cylinders each having a cylindrical portion and a head portion with a spark plug mounted therein, each of said cylinder banks having a cooling system, each of said cooling systems including a coolant jacket having a first portion for cooling the area in the vicinity of said cylindrical portion and a second portion for cooling the area in the vicinity of said head portion, a discharge conduit connected to said second coolant jacket portion for discharging coolant from said second coolant jacket portion, means for supplying coolant to said first coolant jacket portion, and pressure responsive valve means connected between said first and second coolant jacket portions for affording coolant flow from said first coolant jacket portion to said second coolant jacket portion when the pressure in the coolant in said first coolant jacket portion is above a value and for affording continued coolant flow from said first coolant jacket portion to said second coolant jacket portion until the pressure in the coolant in said first coolant jacket portion falls below a second value lower than said first value.

16. A V-type internal combustion engine in accordance with claim 15 wherein said first value is about 5 p.s.i. greater than said second value.

17. A V-type internal combustion engine in accordance with claim 15 wherein said supply means comprises an engine driven pump for supplying coolant to said first coolant jacket portions from a source.

18. A V-type internal combustion engine in accordance with claim 15 wherein each of said cooling systems further includes bypass means for affording a restricted coolant flow between said first coolant jacket portion and said discharge conduit.

19. A V-type internal combustion engine in accordance with claim 15 wherein each of said pressure responsive valve means comprises wall means defining a chamber having an inlet in communication with said first coolant jacket portion and having an outlet including a valve seat in communication with said second coolant jacket portion, a valve member having a first surface and being movable relative to a closed position wherein said first surface sealingly engages said valve seat, said valve member also having a second surface facing away from said first surface, means biasing said valve member towards said closed position, and a diaphragm having a portion connected to said valve member for related movement in common with said valve member, said diaphragm having a side surface positioned in spaced relation with respect to said second surface of said valve member so that coolant entering said inlet from said first coolant jacket portion at a pressure above said first value is effective to displace said valve member from said closed position, and so that said valve member remains displaced from said closed position until the pressure in the coolant entering said inlet falls below said second value.

20. A V-type internal combustion engine in accordance with claim 15 wherein each of said cooling systems further includes a thermostatic valve means connected between said first coolant jacket portion and said second coolant jacket portion for affording coolant flow from said first coolant jacket portion to said second coolant jacket portion when said coolant is above a predetermined temperature.

21. A V-type internal combustion engine in accordance with claim 20 wherein said predetermined temperature is about 140° F.

* * * * *

UNITED STATES PATENT AND TRADEMARK OFFICE

CERTIFICATE OF CORRECTION

PATENT NO. : 4,140,089

DATED : February 20, 1979

INVENTOR(S) : Don F. Kueny, et al.

It is certified that error appears in the above-identified patent and that said Letters Patent are hereby corrected as shown below:

Column 7, line 49, delete "engine", insert -- system --.

Column 8, line 10, after "coolant", insert -- jacket --.

Signed and Sealed this

*Ninth* Day of *April 1985*

[SEAL]

*Attest:*

DONALD J. QUIGG

*Attesting Officer* *Acting Commissioner of Patents and Trademarks*